US011064822B1

(12) United States Patent
Svihilik

(10) Patent No.: US 11,064,822 B1
(45) Date of Patent: Jul. 20, 2021

(54) SNAP TOGETHER FRAME

(71) Applicant: American Direct Sales, LLC, Valparaiso, IN (US)

(72) Inventor: Jeffrey A. Svihilik, Merrillville, IN (US)

(73) Assignee: American Direct Sales, LLC, Valparaiso, IN (US)

( * ) Notice: Subject to any disclaimer, the term of this patent is extended or adjusted under 35 U.S.C. 154(b) by 0 days.

(21) Appl. No.: 16/909,039

(22) Filed: Jun. 23, 2020

(51) Int. Cl.
*A47G 1/06* (2006.01)

(52) U.S. Cl.
CPC ..... *A47G 1/06* (2013.01); *A47G 2001/0688* (2013.01)

(58) Field of Classification Search
CPC . A47G 1/06; A47G 1/0605; A47G 2001/0688
See application file for complete search history.

(56) References Cited

U.S. PATENT DOCUMENTS 899,329 A * 9/1908 Sborigi ..... A47G 1/06 40/765
3,289,341 A * 12/1966 Howell ..... G09F 15/0012 40/782
4,211,022 A * 7/1980 Angelakos ..... A47G 1/06 248/489
4,268,984 A * 5/1981 Taylor ..... G09F 1/12 40/606.12
10,624,473 B1 * 4/2020 Tsai ..... A47G 1/06
2006/0070287 A1 * 4/2006 Shaw ..... G09F 1/12 40/769
2008/0244950 A1 * 10/2008 Golden ..... A47G 1/06 40/777
2013/0160339 A1 * 6/2013 Glennon ..... A47G 1/06 40/757
2015/0107142 A1 * 4/2015 Burrous ..... A47G 1/0605 40/714
2017/0035221 A1 * 2/2017 Huff ..... A47G 1/06
2017/0193865 A1 * 7/2017 Harel ..... A47G 1/06
2019/0125107 A1 * 5/2019 Hsu ..... A47G 1/06

* cited by examiner

*Primary Examiner* — Gary C Hoge
(74) *Attorney, Agent, or Firm* — Botkin & Hall, LLP

(57) ABSTRACT

A snap together frame for displaying an image has a front that releasably connects to a backer. The frame can hold an image to display and allow the image to be exchanged without the outer frame being separated from the backer. The front is formed from J walls that surround an opening for displaying the image, the J walls have centering ribs that support and align the image. The backer has a back wall with an inside perimeter wall and is releasably latchable to the front. When latched, a channel is formed between the front and backer to receive the image that aligns with a slot in one of the J walls.

12 Claims, 12 Drawing Sheets

SNAP TOGETHER FRAME

BACKGROUND OF THE INVENTION

This present disclosure relates to devices and frames for displaying pictures, images, or information. Commonly, picture frames are either wall mounted or standalone, with some picture frames accommodating both uses. Many frames provide means to switch out the image by disassembly of the frame, but these are commonly prone to breakage in the form of broken tangs or clips. Other frames allow the exchange of an image, but are heavier or are more complex. An improved frame where the image can be exchanged without disassembly is needed.

SUMMARY OF THE INVENTION

The present disclosure describes a snap together frame with a front that connects to a backer. An image is held between a front and a backer but can be exchanged without disassembly of the snap together frame. When the front is latched to the backer, a channel is formed that aligns with a slot in one side of the front. The backer is universal, meaning it can be used in the portrait or landscape orientation. The front is specific based on intended orientation. The portrait front has a slot on the top, which is a shorter edge than the sides. The landscape front has a slot on the top, which is the longer edge than the sides. The backer can securely mate to the portrait front or landscape front and has a wider portion nearest the slot for securing the frame to a vertical surface, such as a wall.

The backer has clips that mate to catch walls located on the perimeter of the front. The catch walls hold the clips that retain the backer to the front. The front includes centering ribs that locate and center the image. The centering ribs have a backstop surface that position the backer and cooperate to form the channel for the image.

DESCRIPTION OF THE PREFERRED EMBODIMENT

Figure 1:
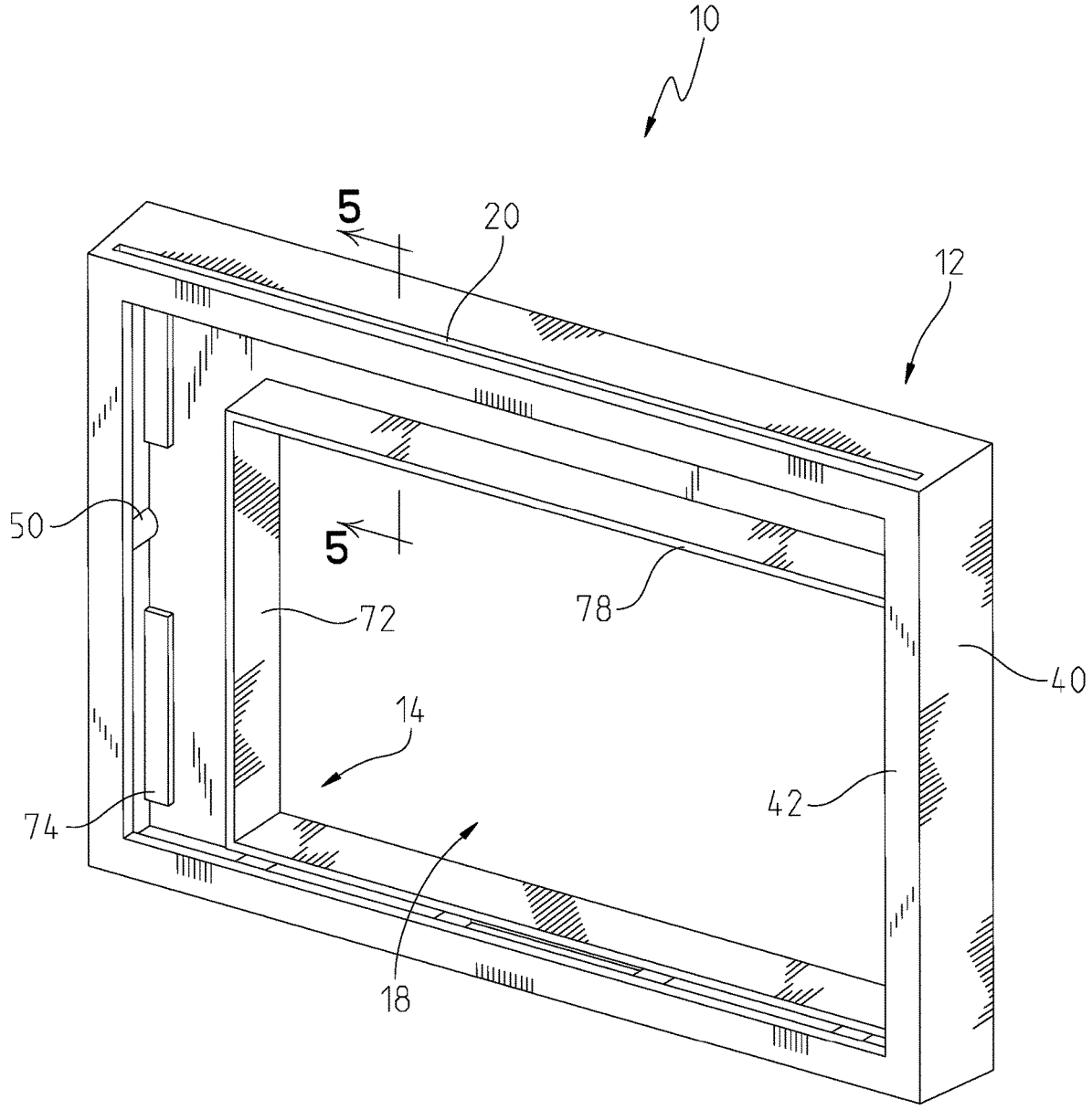
FIG. 1 is a front isometric view of the assembled frame in landscape.

A two-piece frame 10 is shown in FIG. 1. The frame 10 is formed from a front 12 mating with a universal backer 14.

Figure 6:
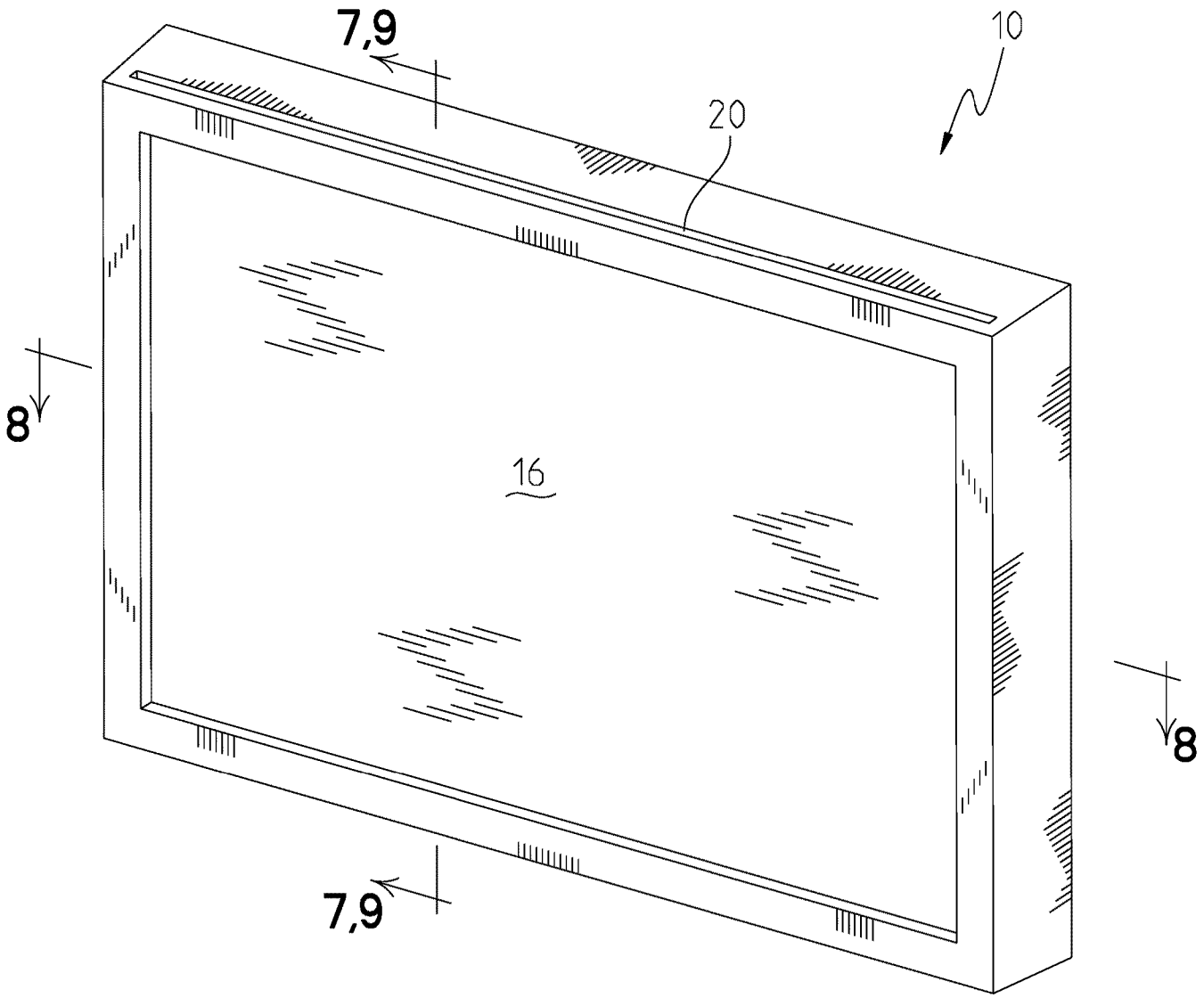
FIG. 6 is a front isometric view of the assembled frame with an image.
Figure 7:
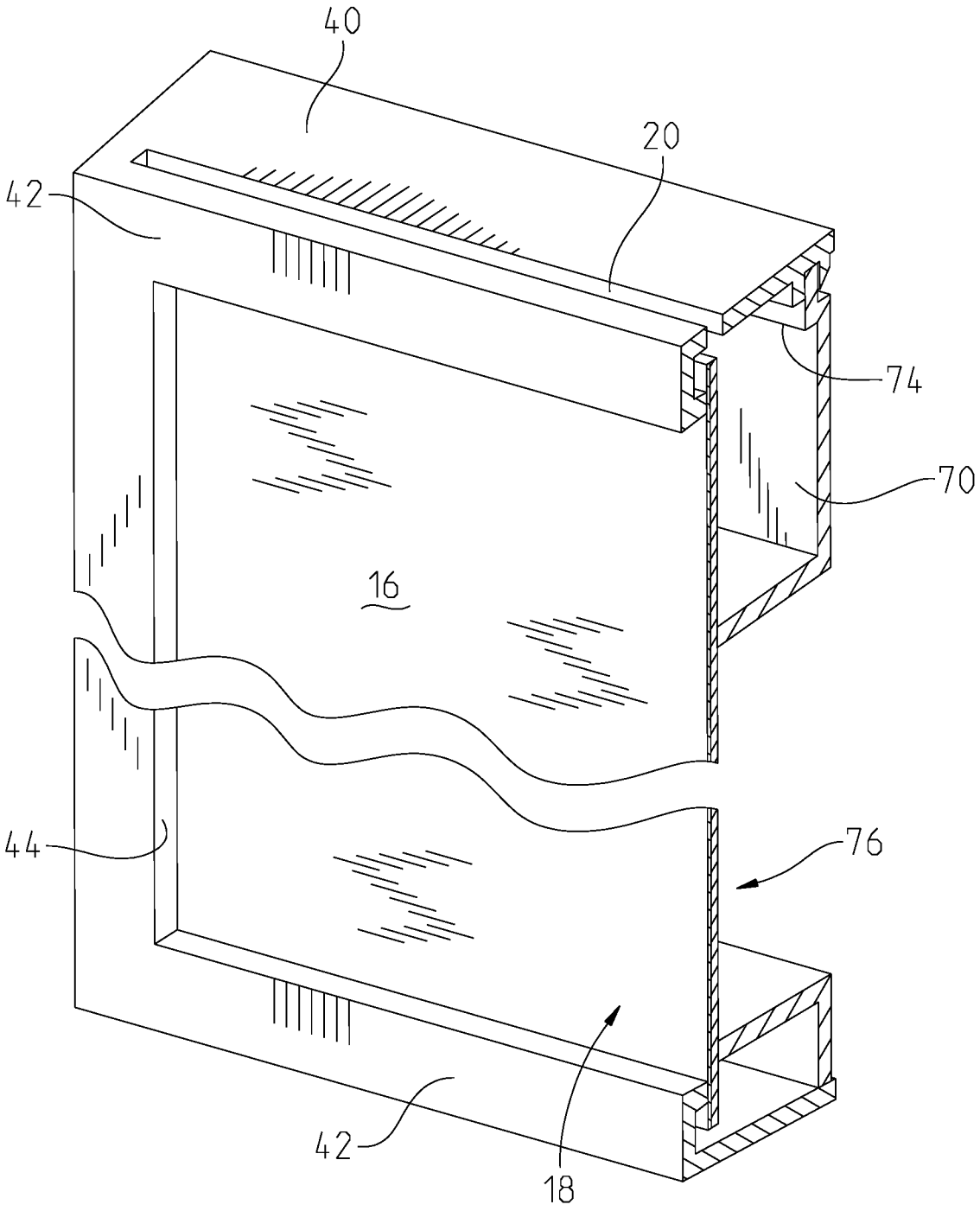
FIG. 7 is a partial isometric view 7-7 of the frame in FIG. 6.
Figure 8:
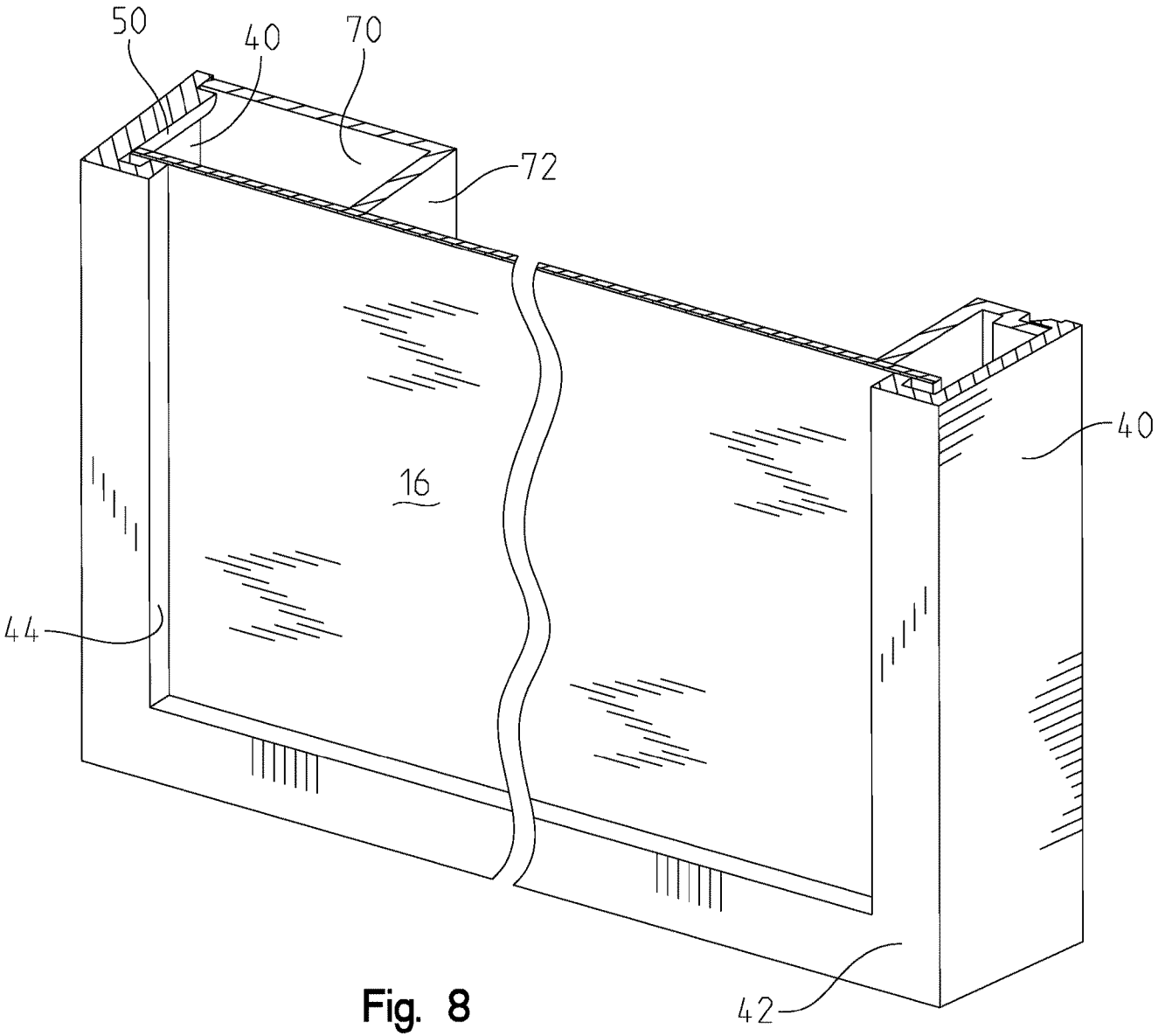
FIG. 8 is a partial isometric view 8-8 of the frame in FIG. 6.
Figure 9:
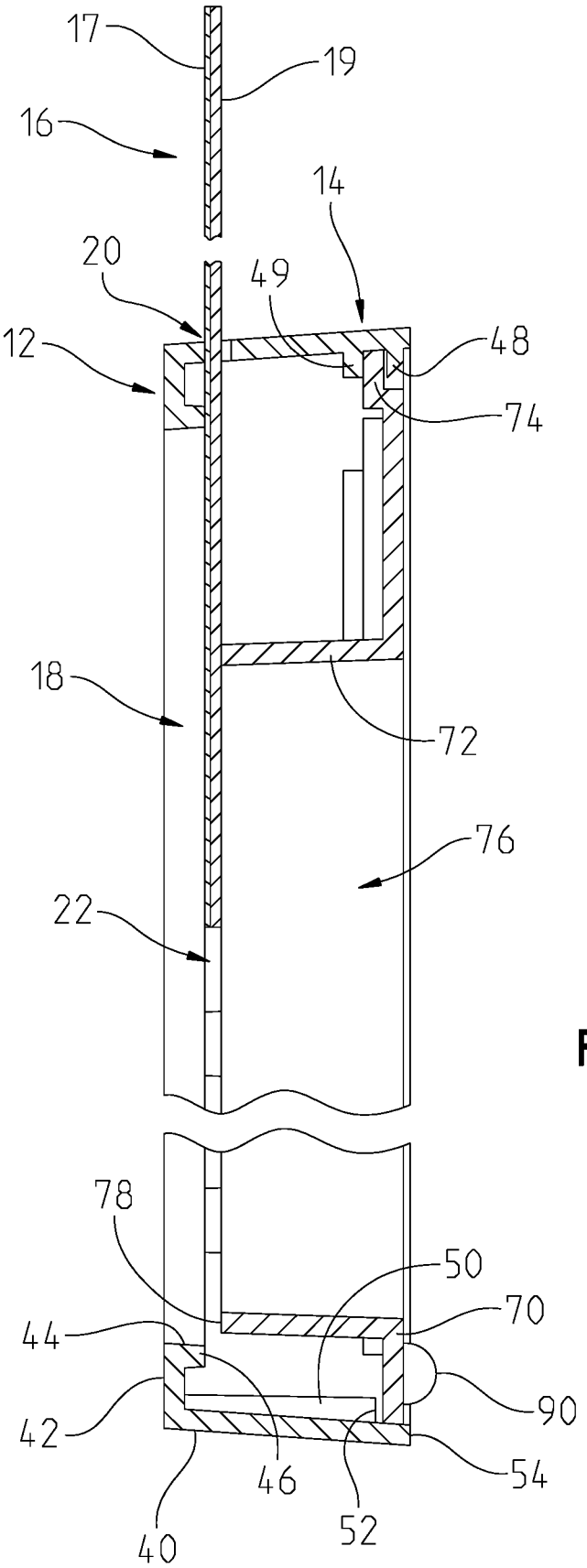
FIG. 9 is a side section view 9-9 of the frame in FIG. 6 with the image partially installed.
Figure 10:
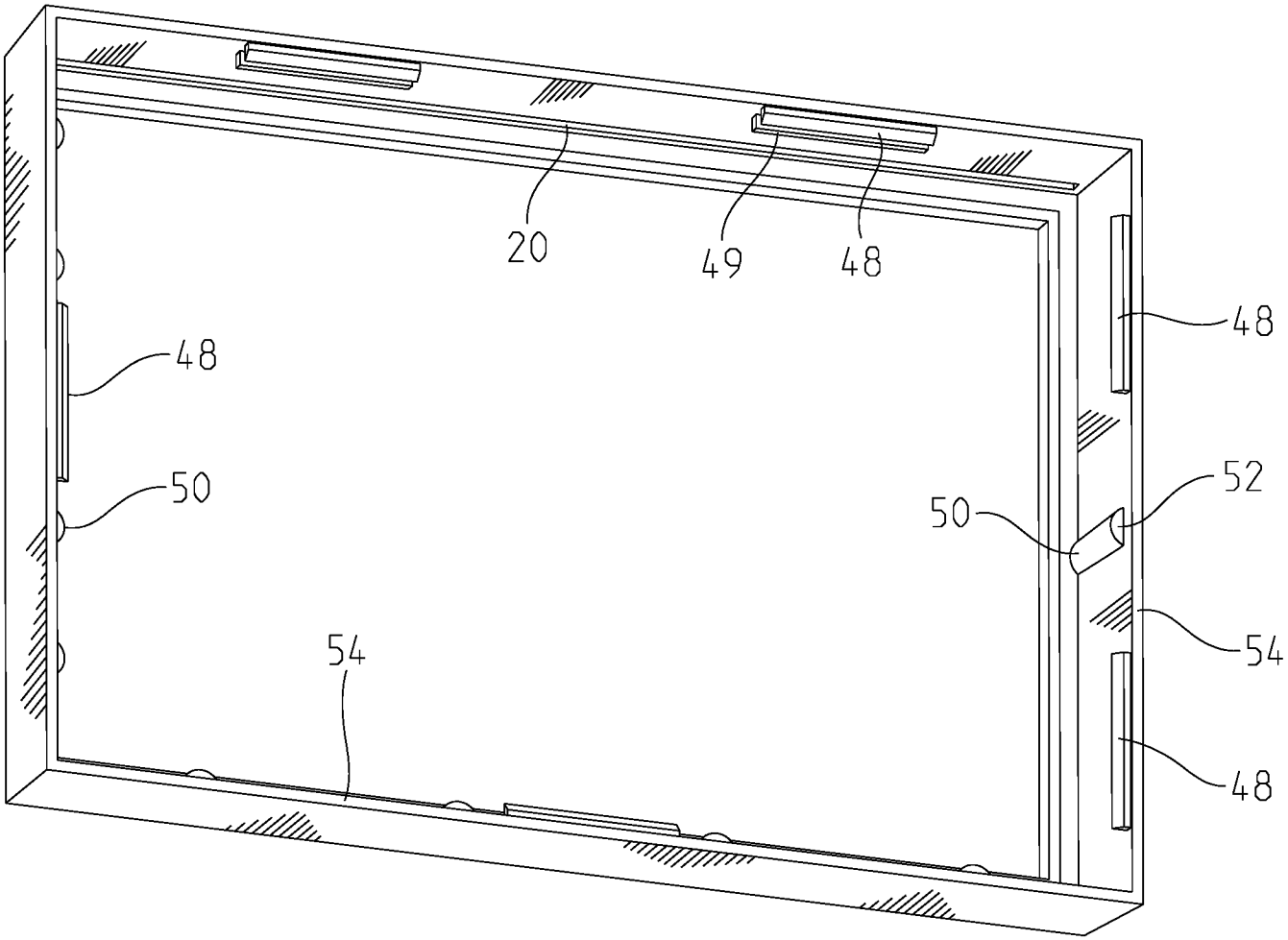
FIG. 10 is a rear isometric view of the front portion of the frame in FIG. 1.
Figure 11:
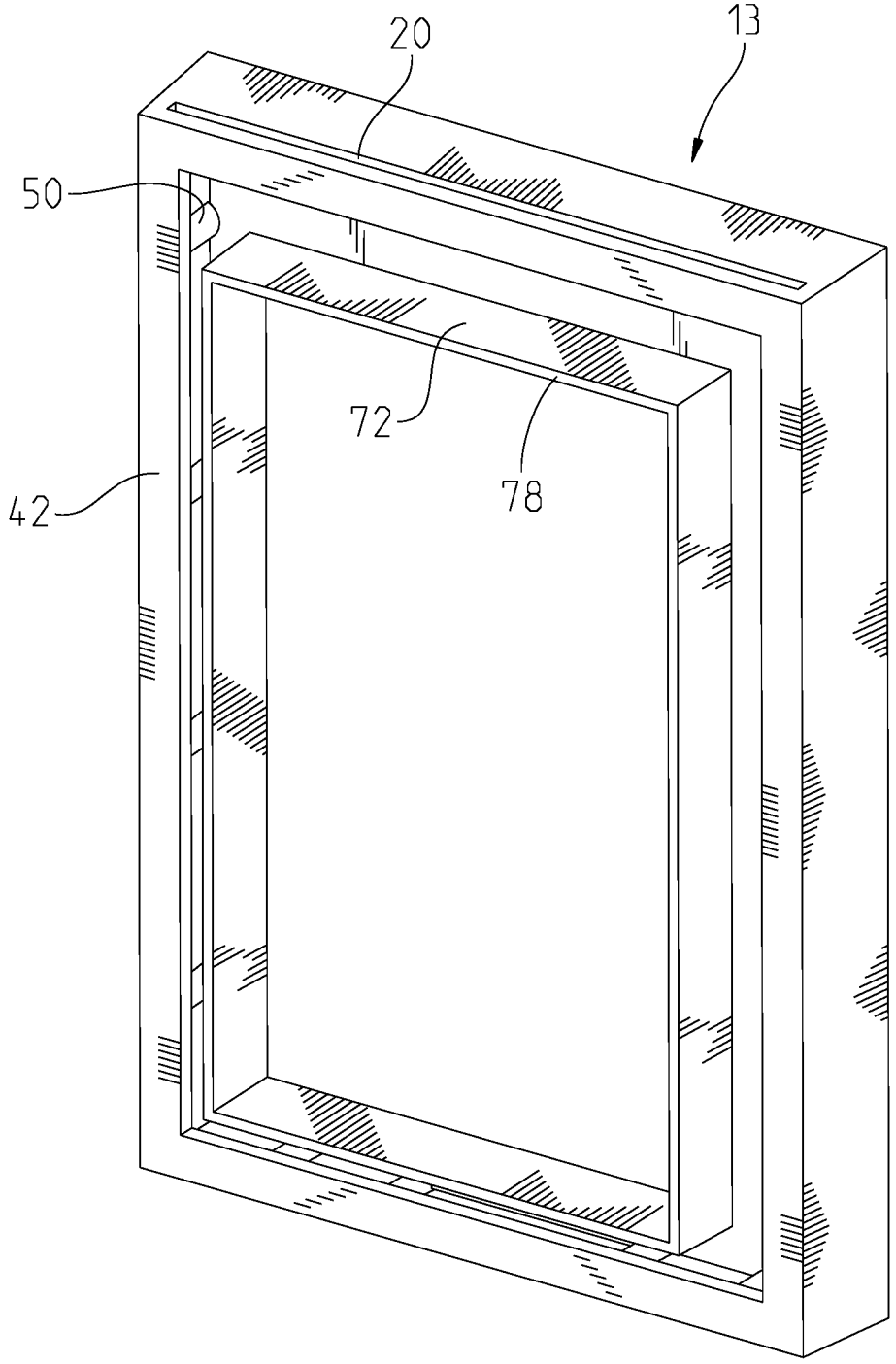
FIG. 11 is a front isometric view of the assembled frame in portrait.
Figure 12:
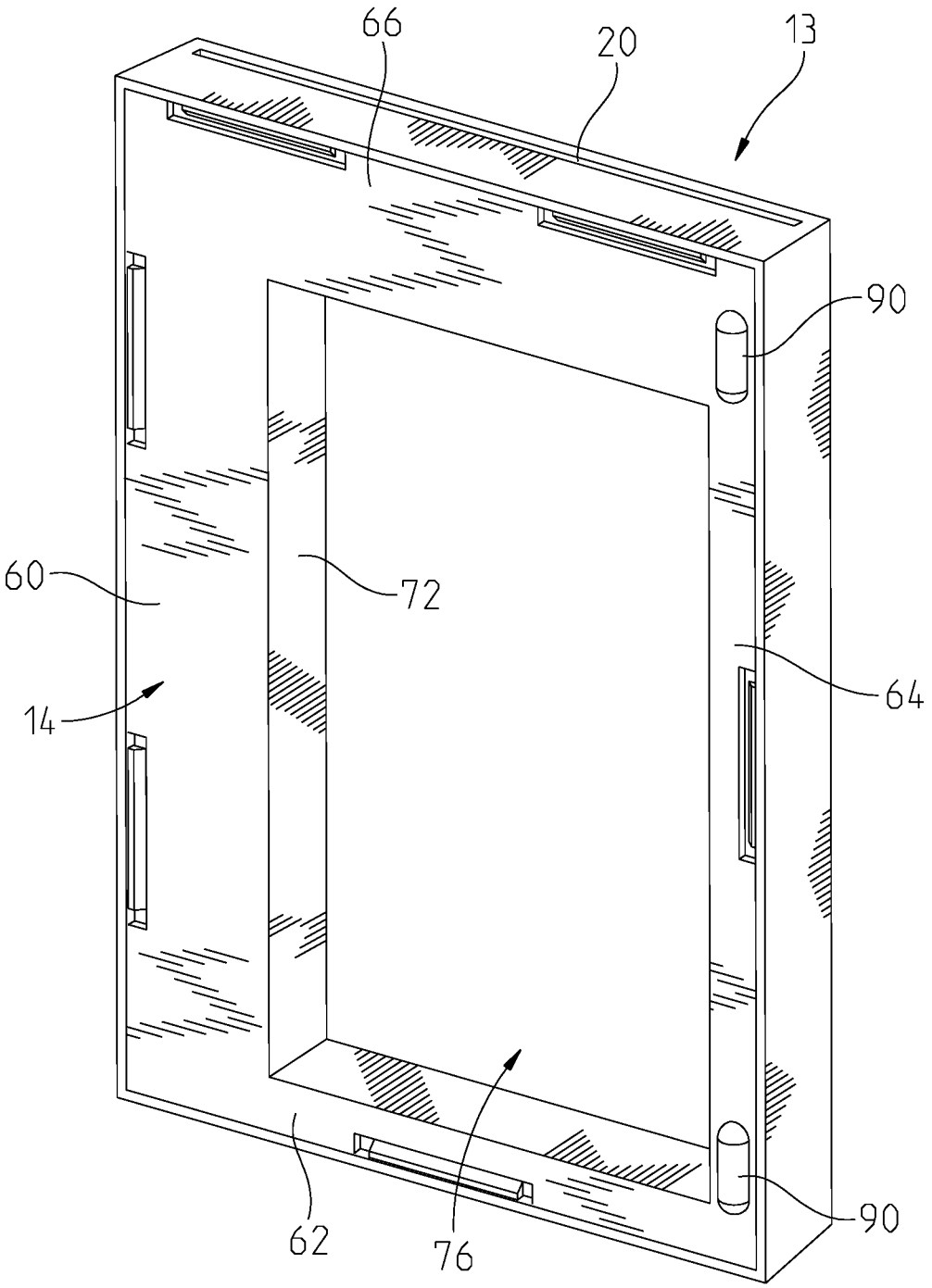
FIG. 12 is a rear isometric view of the assembled frame in FIG. 11.

In use, a picture or image 16 is displayed in the opening 18, as seen in FIG. 6. The image 16 has a displayed surface 17 and an opposite back surface 19, which may include cardstock or other supporting backing. This is shown in FIG. 9. The image 16 is constrained between the front 12 and backer 14 but can be removed through a slot 20 without having to separate the front 12 from the backer 14. The front 12 as shown in FIGS. 1-10 is for use with a landscape orientation image, while the front 13 as shown in FIGS. 11-12 is for use with a portrait orientation image. The backer 14 will mate with either front 12 or front 13.

As assembled, the slot 20 is aligned with a channel 22 that is formed when the front 12 and backer 14 are mated. The channel 22 is shown in FIG. 9.

The front 12 is a single piece integrally formed by four main J walls 30, 32, 34, 36 that are integrally joined at corners. As shown, the front 12 is formed from a single piece of molded plastic, but other materials or manufacturing methods are contemplated. Each J walls has a side wall portion 40 that connects to a front wall portion 42. The front wall portion 42 connects to an offset wall portion 44. The arrangement of the wall portions forms a "J" shape. At the terminal end of the offset wall portion 44 is an image surface 46 that contacts the image 16. The top J wall 30 is different from the other J walls 32, 34, 36 because it includes the slot 20. The other J walls 32, 34, 36 include centering ribs 50 that extend inwardly from the side wall portion 44. The bottom J wall 34 is opposite the top 30, and the side J walls 32, 36 face each other. As shown in FIG. 9, the centering ribs 50 have a backstop surface 52 that is spaced from the wall-facing surface 54. The backstop surface 52 helps to position the backer 14 and prevent it from becoming too close to the front 12, which would restrict the channel 22.

The front 12 has a series of catch walls 48 located in and spaced around the side wall portions 40. The catch walls 48 are short walls that extend inwardly from the side wall portions 40. The catch walls 48 can be formed through other means than by two parallel short walls, such as a series of posts, a step, or any other arrangement that creates an effective channel. The top portion 30 does not include centering ribs 50 but does include a forward stop wall 49. The forward stop walls 49 are shown as aligned with their corresponding catch walls 48.

To describe the front 12 in a different way, it has a frusto-pyramidal outside envelope defined by the angled orientation of the side wall portions 40. As shown in FIG. 9, the side wall portions 40 are angled toward the front wall portion 42. The front wall portion 42 is a planar wall that connects the side wall portions 40 to the offset wall portions 44. The offset wall portions 44 have an image surface 46 that is planar. The centering ribs 50 are portions of cylinders that protrude inwardly from the side wall portions 40. The shape prevents the centering ribs 50 from catching the corners of the image 16 as it is installed on the frame 10. The backstop surface 52 is offset from and parallel to the image surface 46.

The backer 14 is also formed by four portions 60, 62, 64, 66 that are all formed as one piece. As shown herein, the backer 14 is formed from molded plastic, but can also be made from other materials, such as metal. Each portion 60, 62, 64, 66 of the backer has a back wall 70 and an inside perimeter wall 72. Each portion of the back wall 70 has latch walls 74 that are offset from and parallel to the back wall 70. The latch walls 74 are located around the perimeter edge 75 of the back walls 70. The inside perimeter wall 72 surrounds an opening 76 and terminates at a backer surface 78. The backer surface 78 is planar and parallel to the back wall 70. Portions 60 and 66 are different from the other portions 62, and 64. On portions 60 and 66, the back wall 70 is wider to be used for hanging the frame 10 to a surface, such as a wall. The wider portions of the back wall 70 can include adhesive pads, hook-and-loop fasteners, or other materials that can be used to attach to a wall or other vertical surface.

The backer 14 includes feet 90 that protrude outwardly from the back wall 70. The feet 90 provide a distance to offset the back wall 70 from a wall or other surface when the two-piece frame 10 is installed. As installed or mounted, the feet 90 account for the thickness of any mounting tape, fasteners, or other component that would offset the back wall 70 where it attaches to the wall or other surface.

Figure 2:
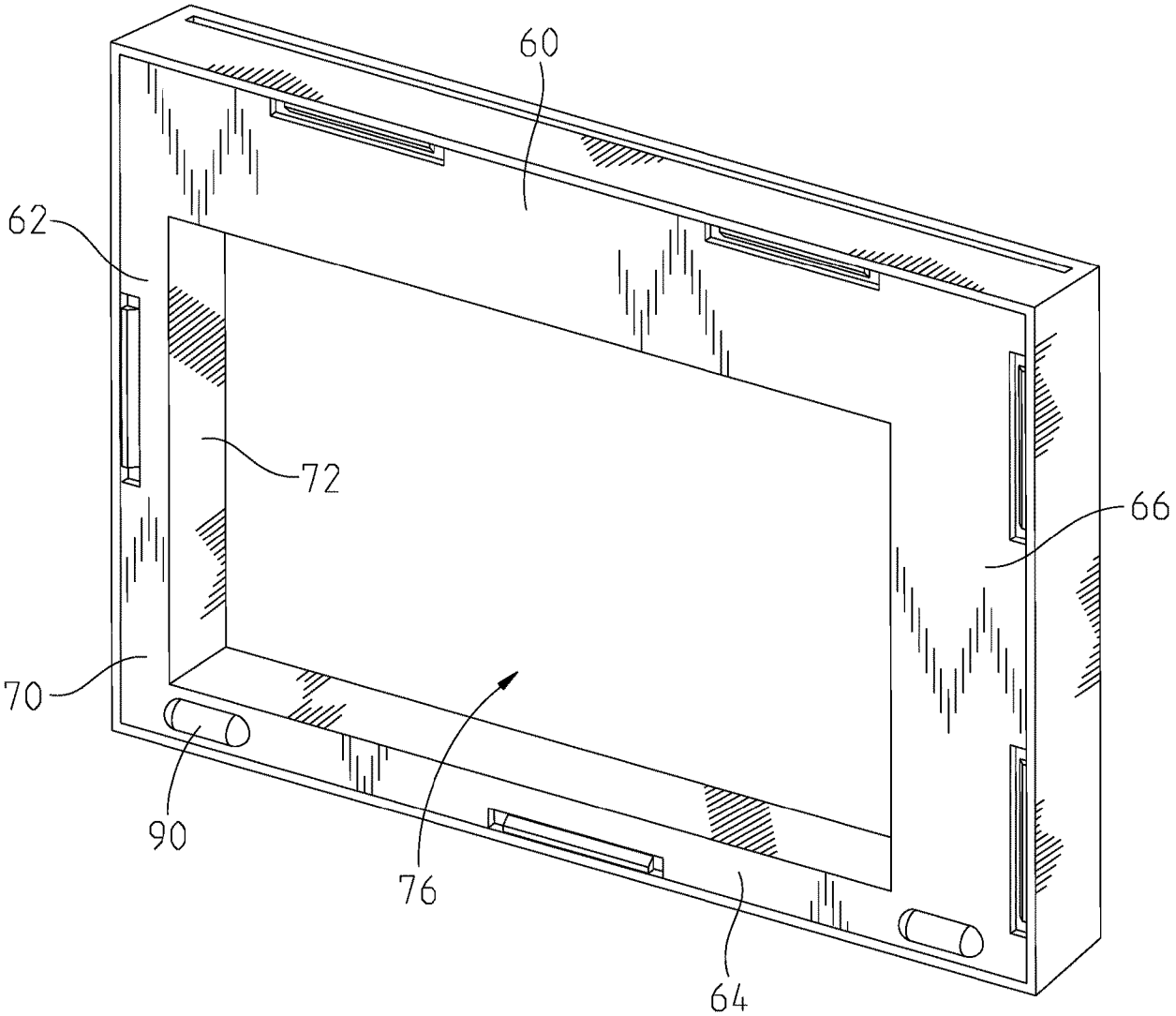
FIG. 2 is a rear isometric view of the assembled frame in FIG. 1.
Figure 3:
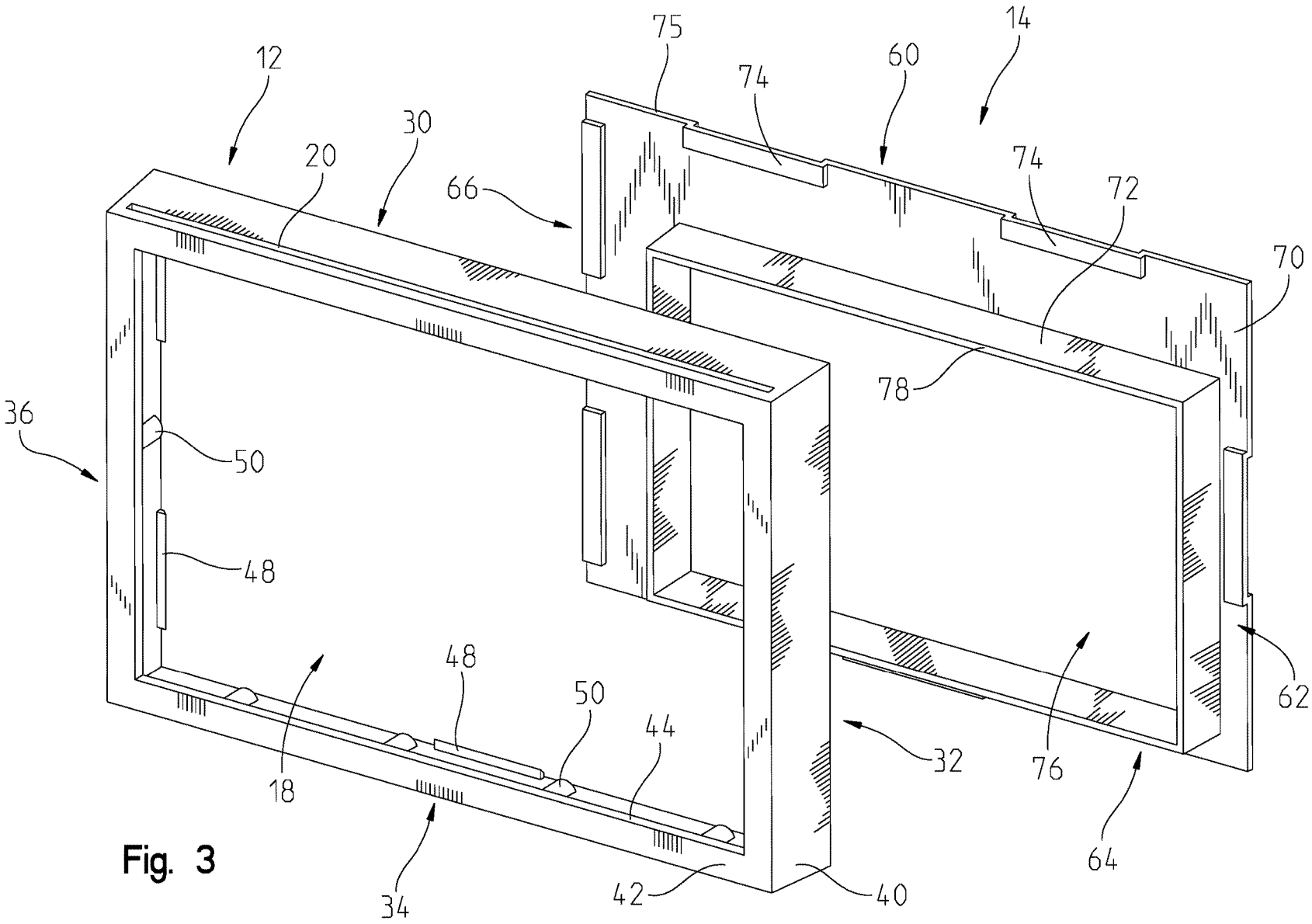
FIG. 3 is a front isometric view of the frame in FIG. 1 before assembly.
Figure 4:
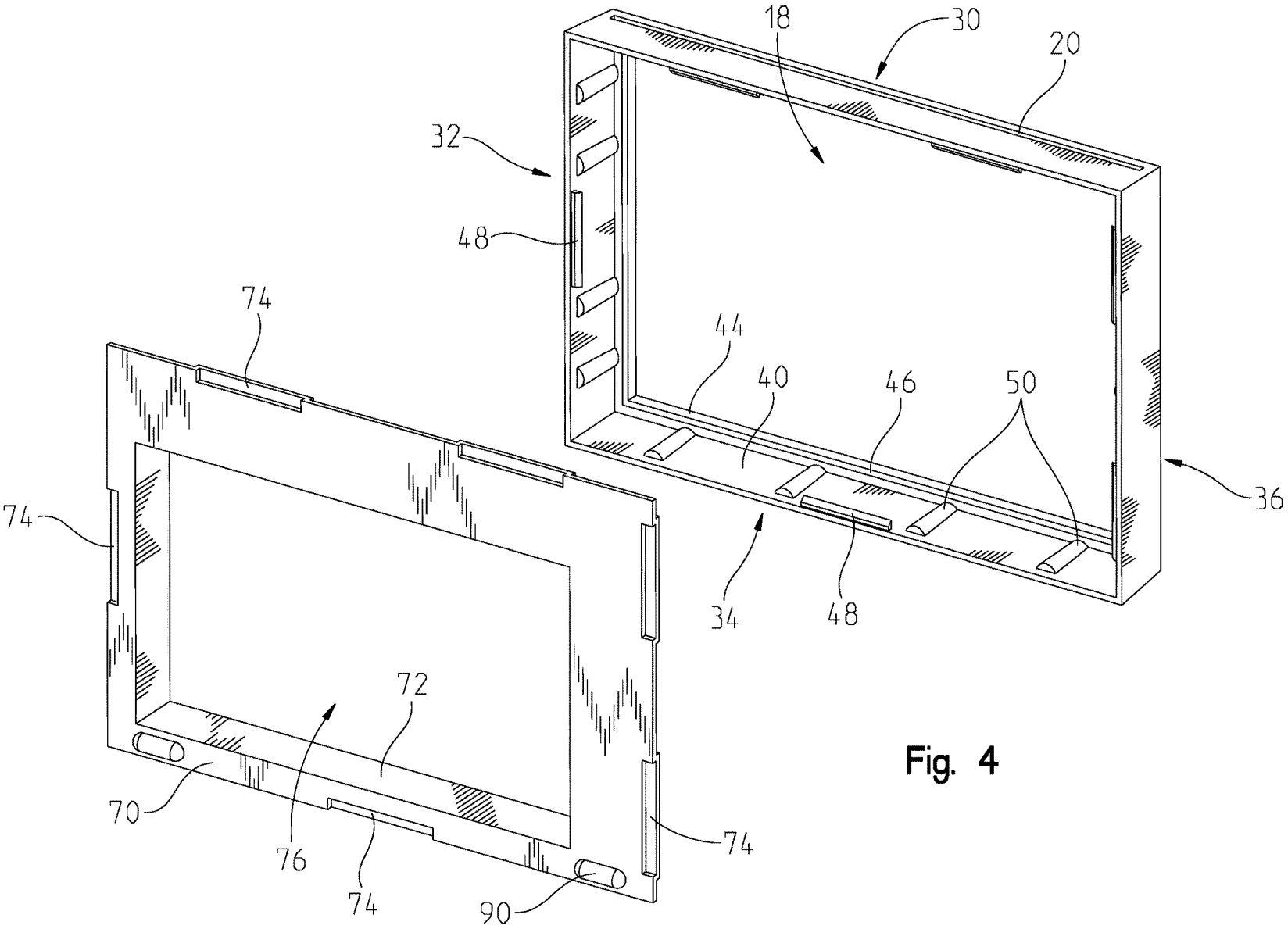
FIG. 4 is a rear isometric view of the frame in FIG. 2 before assembly.
Figure 5:
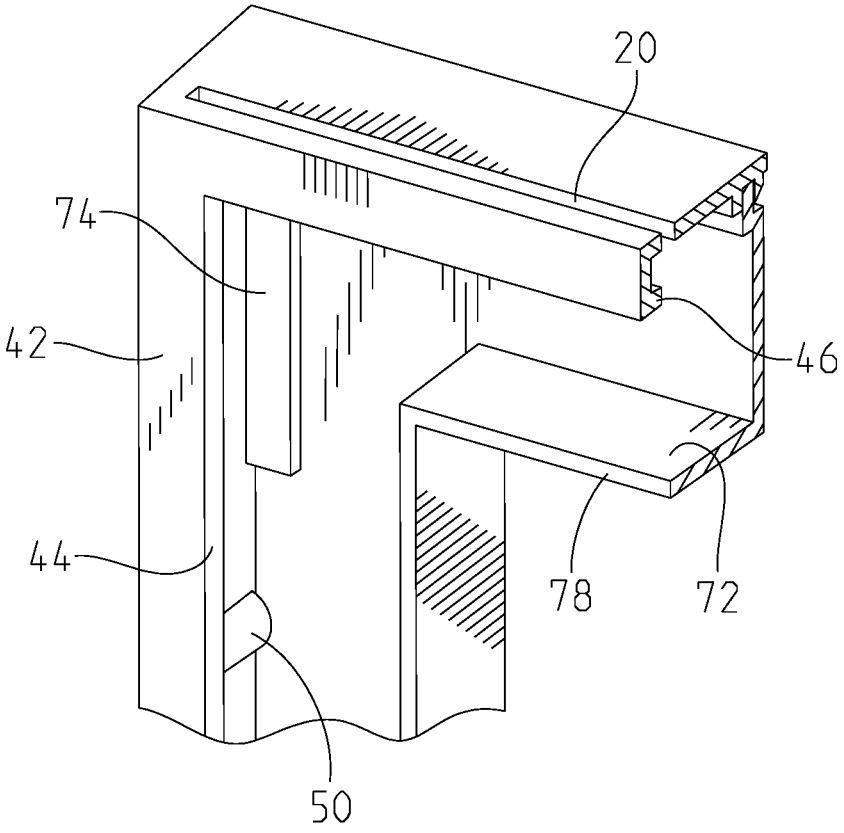
FIG. 5 is a partial isometric view 5-5 of the assembled frame in FIG. 1.

As shown, the backer 14 can only mate to the front 12, 13 in one orientation, due to the placement of the catch walls 48 and latch walls 74. As can be seen in FIGS. 2 and 4, there are latch walls 74 that are complementary to the catch walls 48. They are complementary based on the number and location only aligning when the backer 14 is properly positioned with respect to the front 12.

It is contemplated that the two-piece frame 10 is square. In that event, the backer 14 would only have one portion of the back wall 70 that is wider. That wider portion would be aligned with the portion 30 that includes the slot 20.

To assemble the frame 10, the user aligns the front 12, 13 so the latch walls 74 are aligned with the catch walls. The user then applies pressure to temporarily displace the catch walls 48 and move the backer 14 to the latched position, shown in FIG. 9. A lead-in surface on the catch walls 48 facilitates the alignment and latching of the two components. The front 12, 13 is now mated to the backer 14 as shown in FIGS. 1 and 2. The user then slides the image 16 through the slot 20 and into the channel 22. The frame 10 can then be mounted to a wall using adhesive, hook-and-loop fasteners, hooks, or other equivalent mounting method. As mounted on a wall, the image 16 only contacts the image surface 46, backer surface 78 and centering ribs 50. While not shown, the back wall 70 can also include any number or style of mounting holes, such as keyhole, sawtooth, or the like.

Exchanging the image 16 can be done without removing the frame 10 from the wall. The image 10 is moved upwardly and through the slot 20, with the new image installation being the opposite of removal.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A two-piece frame for holding and displaying an image, said image being exchangeable without disassembly of said frame, said two-piece frame comprising:

a front formed from a plurality of J walls orthogonally joined at corners to form a continuous perimeter, opposing said J walls being parallel to each other, each said J walls having a side portion extending to a front portion, said front portion extending in a direction towards an oppositely located said J wall to an offset wall portion, said offset wall portion terminating at an image surface, each said J walls having a catch wall, one of said J walls is a top J wall having an elongate slot extending through said side portion, the other of said J walls having centering ribs, each said centering rib formed from a cylindrical surface extending from an inside surface of said side portion and terminating at a backstop surface parallel to and spaced from said front portion, said top J wall having a forward stop wall spaced from and parallel to said catch wall, each said catch wall spaced from each said centering rib on said J walls;

a backer having a back wall integrally joined to an inside perimeter wall, said inside perimeter wall extending from said back wall surrounding a central opening, said inside perimeter wall terminating at a backer surface, said back wall having latch walls disposed around a perimeter edge parallel to said back wall, said latch wall for being retained by said catch wall;

when said backer is in latched engagement with said front, said latch walls are retained by said catch walls, said backer surface and said image surface cooperating to form a channel aligned with said elongate slot for receiving said image; and when said frame receives said image through said elongate slot, corners of said image contact said cylindrical surface of said centering ribs to center and guide said image, said cylindrical surfaces prevent catching of said corners.

2. The two-piece frame in claim 1, wherein said backstop is for contacting said back wall to maintain a distance between said backer surface and said image surface.

3. The two-piece frame in claim 1, further comprising feet integrated into and extending from said back wall in a direction opposite from said inside perimeter wall, said feet extending from said back wall by a distance equal to a thickness of mounting tape affixed to another portion of said back wall.

4. The two-piece frame in claim 1, wherein said backer is releasably latched to said front.

5. The two-piece frame in claim 4, wherein latch walls and said catch walls are located so that said backer can be latched to said front in only one orientation.

6. The two-piece frame in claim 1, wherein said front and said backer are formed from molded plastic.

7. A snap together frame for displaying a replaceable image having a front-facing display surface and an oppositely located back surface, said frame comprising:

a front having a frusto-pyramidal perimeter wall extending between a wall-facing surface and a planar front portion, said front portion surrounding a display aperture and including an inner perimeter wall forming an offset portion, said offset portion terminating at an image surface, said image surface parallel to and spaced from said planar front portion, said front having an elongate slot extending through one of said frusto-pyramidal walls for receiving said replaceable image, said frusto-pyramidal wall having a plurality of catch walls adjacent said wall-facing surface, said front having centering ribs, each said centering rib formed from a cylindrical surface extending from an inside surface of said frusto-pyramidal walls, each said cylindrical surface terminating at a backstop surface parallel to said planar front portion;

a backer releasably latchable to said front, said backer having a back wall portion with an aperture extending therethrough, said back wall portion having a wall-facing surface said backer having an inside perimeter wall surrounding said aperture, said inside perimeter wall extending away from said back wall portion and terminating at a backer surface parallel to said back wall portion;

when said frame receives said image through said elongate slot, corners of said image contact said cylindrical surface of said centering ribs to center and guide said image, said cylindrical surfaces prevent catching of said corners; and when said backer is in latched engagement with said outer frame, said backer surface spaced from and parallel to said image surface to form a channel for holding said replaceable image.

8. The snap together frame in claim 7, wherein latch walls and said catch walls are located so that said backer can be latched to said front in only one orientation.

9. The snap together frame in claim 7, wherein said front and said backer are formed from molded plastic.

10. The snap together frame in claim 7, further comprising feet extending from said back wall in a direction opposite from said inside perimeter wall.

11. The snap together frame in claim 7, wherein said backer is constrained by said backstop surface and said catch walls.

12. The snap together frame in claim 7, further comprising forward stop walls located between said elongate slot and said catch walls.

* * * * *